US005562344A

United States Patent [19]

Hallings

[11] Patent Number: 5,562,344

[45] Date of Patent: Oct. 8, 1996

[54] HANDLE FOR DENTAL LIGHT

[75] Inventor: Leonard L. Hallings, East Rochester, N.Y.

[73] Assignee: MDT Corporation, Morrisville, N.C.

[21] Appl. No.: 194,688

[22] Filed: Feb. 10, 1994

[51] Int. Cl.[6] ..... F21V 19/02

[52] U.S. Cl. ..... 362/418; 362/399; 362/427; 362/804

[58] Field of Search ..... 362/33, 287, 399, 362/418, 427, 428, 804, 269

[56] References Cited

U.S. PATENT DOCUMENTS

| | | | |
|---|---|---|---|
| 4,581,689 | 4/1986 | Oram | 362/287 |
| 4,722,502 | 2/1988 | Mueller et al. | 362/427 |
| 4,849,864 | 7/1989 | Forrest | 362/427 |
| 4,878,156 | 10/1989 | Hallings et al. | 362/804 |

FOREIGN PATENT DOCUMENTS

| | | | |
|---|---|---|---|
| 304041 | 2/1918 | Germany | 362/428 |

*Primary Examiner*—Denise L. Gromada
*Assistant Examiner*—Y. Quach
*Attorney, Agent, or Firm*—Trask, Britt & Rossa

[57] ABSTRACT

A handle system for dental operatory lights of the type in which a light head is mounted to be moved in space and oriented in direction to focus and direct light through a lens includes a pair of mounting posts carried at opposite sides of the light, the posts being approximately mirror image duplicates of each other, and a pair of approximately identical interchangeable symmetrical handle members. Each handle member includes a mounting head portion and a grip portion. The mounting head has a transverse channel extending between its opposite sides, having a cross-sectional configuration adapted to register with either of the posts. The opposite sides of the mounting head are configured as a hilt. The grip is held at a canted orientation with respect to the lens. The mounting heads and posts carry intercooperable latching structure.

29 Claims, 2 Drawing Sheets

HANDLE FOR DENTAL LIGHT

BACKGROUND OF THE INVENTION

1. Field of the Invention

This invention relates to operatory lighting. It is particularly directed to lights used to illuminate the oral cavity, and provides a novel handle structure for such lights.

2. State of the Art

Surgical lighting is a well developed field. Generally, such lights include a head assembly mounted on an articulating structure to permit spatial repositioning of the light head as appropriate. One or more lamps are mounted within a housing of the assembly to emit light through a lens. The lens functions as a physical barrier to prevent contact with a hot light source. It also functions in many cases to diffuse, and in some instances to filter, the light. Some head configurations incorporate a mechanical system for focusing the light by manipulating the relative orientations of a plurality of individually mounted lamps. Typical surgical lights and their manner of use are disclosed, for example, in U.S. Pat. Nos. 4,316,237 and 4,878,156.

One or more handles are typically carded by the light head to facilitate spatial reorientations of the head. The handles of a surgical light may be integral with the light head. Modem lights usually are equipped with removable handles, however. The handles may be sterilized prior to reuse. In other instances, the handles are provided as, or replaced by, interchangeable, pre sterilized, disposable structures. The aforesaid '156 patent, for example, the disclosure of which is incorporated by reference, discloses a quick-release focusing handle which may be provided in either sterilizable or disposable form.

Surgical lights used in dental operatories are somewhat specialized in design. The partially seated postures typical of a dental patient in a patient chair differ from the supine position typical of a medical patient lying on a table. Oral surgery imposes a special requirement of providing excellent illumination for an oral cavity. A dental operatory differs in arrangement from a typical medical operatory; fewer personnel are involved in most dental surgeries, and an oral surgeon thus tends to be more proactive in positioning the light.

A dental light is usually focused by positioning the lens at the appropriate distance and orientation with respect to the oral cavity of a patient. Accordingly, the surgeon or dental assistant may find it necessary to grasp the handles associated with the light head from time to time during a procedure, particularly if the patient's head is repositioned. The handles are thereby contaminated.

The importance of maintaining sterile or aseptic conditions in a dental operatory has been increasingly well recognized. Certain expedients which have been adopted for maintaining clean conditions in a dental operatory are discussed by the introductory portions of U.S. Pat. No. 4,930,058, the disclosure of which is incorporated by reference.

The '058 patent discloses in particular a quick-release dental light handle. The handle is constructed to be detachable for sterilization and reuse. The provision of a sterilizable handle is responsive to the reality that dental light handles inevitably become contaminated during a procedure. A drawback of the specific handle structure disclosed by the '058 patent is its size. A large sterilizer is required effectively to process such a large device. Sterilization equipment of this size is not routinely available to dental operatories.

A troublesome inconvenience is experienced by dental surgeons when attempting properly to position and orient the lens of a dental light. Handles are ordinarily provided at opposite sides of the light head to facilitate positioning from either side of the patient chair. The dentist simply grasps the handle and moves the light head to the desired distance from the patient's oral cavity. Unfortunately, movement of the light head in this fashion inevitably disturbs the directional orientation of the lens. Significant additional manipulations are generally required to achieve a proper reorientation.

There remains a need for a quick-release handle structure for dental lights which avoids the drawbacks of available such handles. Specifically, there is a need for a handle of relatively small size and of a configuration which assists one repositioning the light head to bring the lens into a nearly appropriate directional orientation.

SUMMARY

In summary, this invention provides a handle system for operatory lights of the type in which a light head is mounted to be moved in space and oriented in direction to focus and direct light through a lens. The system generally includes a pair of mounting posts carded at opposite sides of the light. The posts will ordinarily be structured as mirror image duplicates of each other. A pair of approximately identical interchangeable symmetrical handle members are mountable on the posts. Each handle member includes a mounting head portion and a grip portion. The mounting head has a transverse channel extending between its opposite sides. The channel generally has a cross-sectional configuration adapted to register with either of the posts. With a handle mounted on a post, the grip of that handle is typically held at a canted orientation with respect to the lens. The mounting heads and posts carry intercooperable latching structure.

In a typical embodiment, the light head of a dental operatory light is mounted on support structure which permits the light head to be moved in space and oriented in direction, whereby to focus and direct light through a reference plane to a target region. The reference plane is normally congruent with the most forward surface of the light head, and is typically occupied by a lens structure. The target region, in the case of a dental light, is nearly always an oral cavity. For purposes of this disclosure, the lens is regarded as at the front of the light head, and the left and right sides of the light head are regarded as being viewed from the front, that is from the reference plane or lens.

The handle system of this invention includes one or more mounting posts carded by the light head and having an irregular cross-sectional configuration or other means to register with one or more corresponding handles. In most cases, first and second mounting posts are carded at the left and right sides, respectively, of the light head. Each handle member in the system is structured with a mounting head portion and a grip portion extending from the mounting head portion. The mounting head portion typically includes a transverse channel with a cross-sectional configuration shaped and dimensioned to register with each mounting post in the system. The mounting head and grip portions are constructed and arranged such that when the mounting head portion is installed upon a post, the grip portion of the handle is fixed in a selected canted orientation with respect to the reference plane.

The preferred handle systems further include latching assemblies comprising first structure carried by the mounting post and second structure carded by the mounting head of the handle. The first structure ideally includes finger actuatable means for releasably locking the mounting head to the post. The second structure is constructed and arranged to cooperate with the first structure, releasably to connect the handle to the post. The first structure may include a spring biased plunger mechanism and the second structure may include registration means constructed to engage the plunger, for example.

The plunger ideally includes a distal portion constituting the finger actuatable means and a detent portion. The registration means ideally comprises a well adapted to receive the detent portion. In that case, the first and second structures are constructed and arranged so that finger pressure applied to the distal portion effects a disengagement of the detent portion from the well, whereby to permit removal of the handle member from the mounting post.

A slot may be provided approximately parallel the channel through the mounting head portion of the handle. The plungers carded by each mounting post in the system are then best mounted such that they will inevitably project through that slot as a mounting head is moved onto and off from any such post. The latching structure may be located approximately midway with respect to the posts and channels so that latching registration is effected no matter which handle is attached to which post.

When a handle is mounted on a post, the grip portion of the handle should be canted downwardly and forwardly at an angle which assures an approximately desired directional orientation of the light emanating from the light head when the grip is brought to an approximately vertical orientation. The angle of intersection between the longitudinal axis of the grip and the reference plane is ideally selected at approximately 33 to 34 degrees, plus or minus about ten degrees, the extreme range being between about 20 and about 45 degrees. Although not critical, the grip portion should ordinarily be at least about three inches in length.

Preferably, all of the handles in the system, usually two, when mounted, will be positioned substantially entirely behind the reference plane. Moreover, each handle member should be approximately symmetrical with respect to a central plane transverse the mounting head portion. Such symmetry permits the mounting head portion of any handle to be installed upon any mounting post member in the system. It further assures that when a handle is so installed on any such post the grip portion of the handle is fixed in the selected canted orientation with respect to the reference plane.

BRIEF DESCRIPTION OF THE DRAWINGS

In the drawings, which illustrate what is currently regarded as the best mode for carrying out the invention.

DETAILED DESCRIPTION OF THE ILLUSTRATED EMBODIMENT

Figure 1:
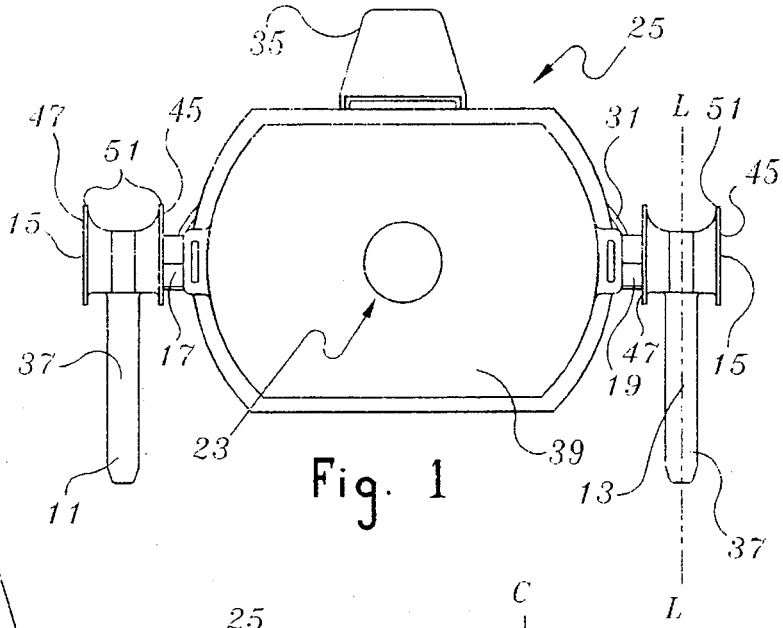
FIG. 1 is view in elevation of a dental lamp head assembly carrying a pair of handles of this invention.

Typical handles 11, 13 of this invention are shown installed by sliding their respective mounting heads 15 on respective mounting posts 17, 19 carded by a head assembly, designated generally 23, of a dental fight, partially shown and designated generally 25. The head 23 is pivotally supported distally from a yoke 31, as shown. The yoke 31 is pivotally connected to a housing 35, which is typically carded by articulating support structure (not shown.)

The handles 11, 13 are mounted at opposite sides of the head assembly 23 in generally conventional fashion. As so mounted, respective grips 37 of the handles 11, 13 are positioned for grasping by the hand of an individual responsible for positioning the lens 39 of the fight 25 with respect to a target, such as the oral cavity of a patient (not shown.) The head assembly 23 can thus be repositioned at will by grasping a handle 11, 13 and "dragging" the head 23 to the desired region in space. The shape and dimension of the handles 11, 13 assure a substantially proper orientation of the lens 39 when the grip 37 is approximately vertical.

Figure 2:
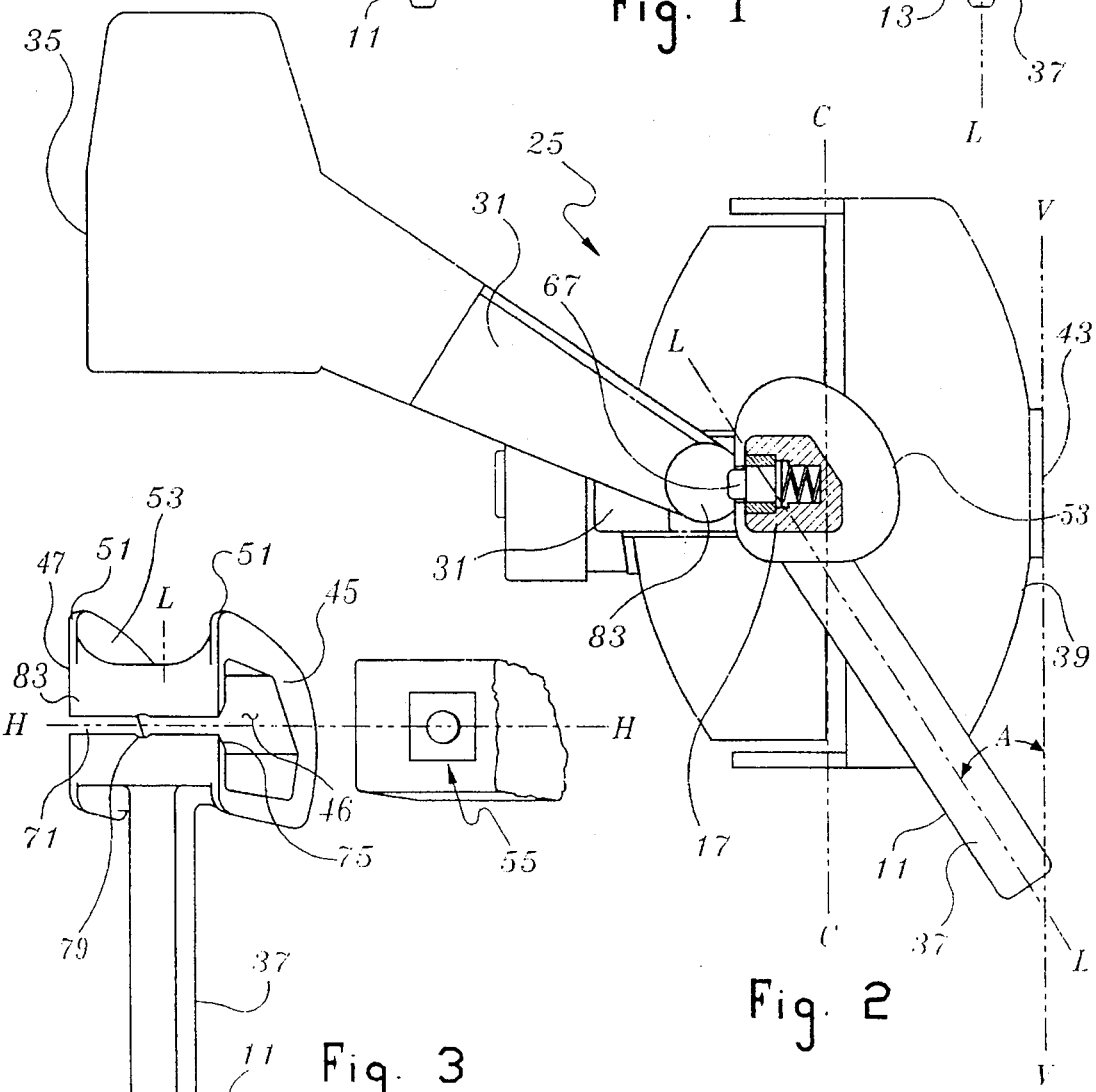
FIG. 2 is a view of the structure of FIG. 1 rotated counterclockwise 90 degrees as viewed from above, partially in section.

As best shown by FIG. 2, the handle 11 is configured so that when it is mounted on the post 17, the grip 37 extends diagonally between approximately parallel planes encompassing reference lines C and V, respectively. As illustrated, the reference line C is assumed to be oriented approximately vertically and to intersect the longitudinal axis L of the grip 37. The reference line V is then also vertically disposed, and lies in a plane defined by the most forward surface 43 of the light head assembly 23. The grip 37 has sufficient length for easy grasping, and is canted to intersect the plane of fine V, forming an angle A. The entire handle 11 thus fits substantially entirely to the rear of the plane encompassing the forward surface 43.

In use, when the handle 11 is grasped to reposition the light head assembly 23, the grip 37 is naturally brought to a substantially vertical position, thereby pivoting the lens 39 through an arc of approximately angle A with respect to vertical. The length of the grip 37 and the dimensions of the assembly 23 between the reference lines C, V are selected to effect an appropriate included angle A. A preselected angle A of proper magnitude assures that the lens 39 will inevitably be brought to approximately the desired orientation when the assembly 23 is repositioned by means of the handle 11.

Although the specific dimensions of the assembly 23 and the handles 11, 13 may be selected from within broad ranges, the handle grip 37 should be of sufficient length to accommodate a large human hand. In practice, an axial length of at least about 3 inches is preferred. As illustrated, angle A is approximately 33½ degrees, which is considered to be ideal. Angles ranging from about 20 to about 45 degrees are generally operable, although the preferred range of angle A magnitude is between about 27 and about 40 degrees.

Figure 5:
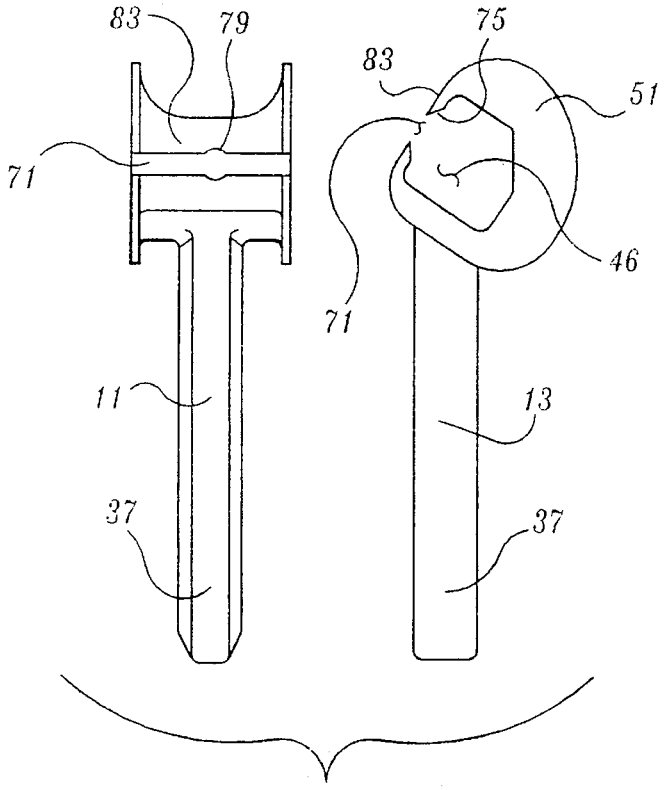
FIG. 5 is a view in elevation of a pair of handles of this invention rotated 90 degrees with respect to each other.
Figure 6:
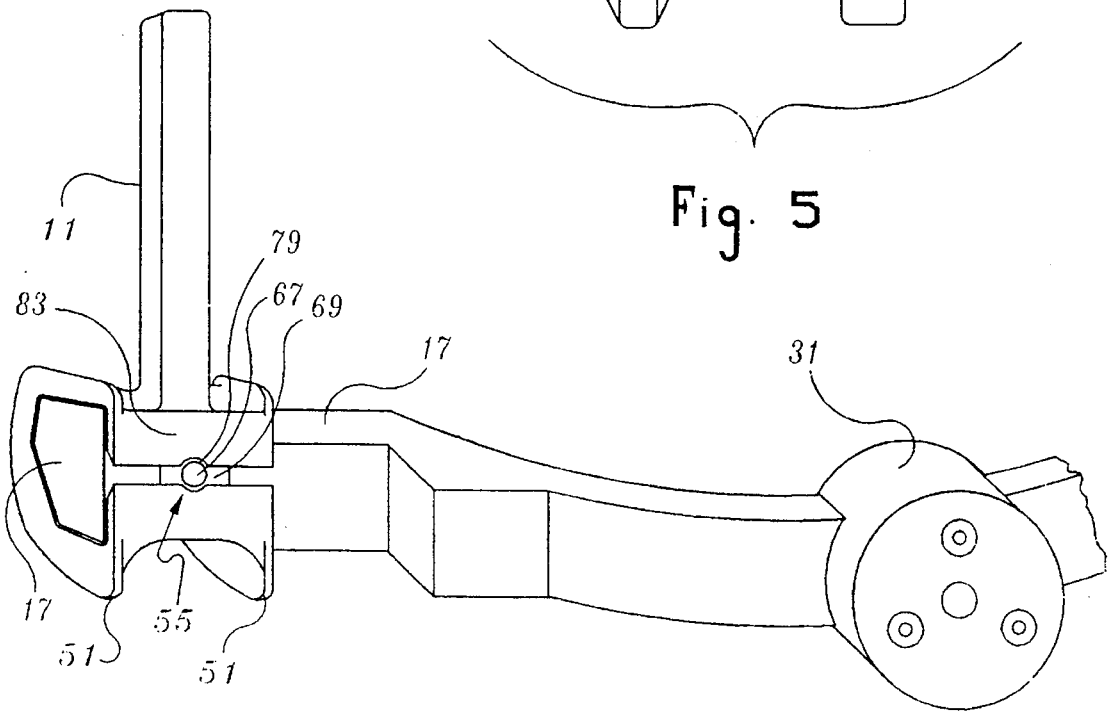
FIG. 6 is a pictorial view of a handle mounted on a post integral with a yoke support.

Referring to FIGS. 1 and 5, the handles 11, 13 illustrated are approximately identical and interchangeable. That is, the handle 11, or alternatively, the handle 13, may be mounted on either of the posts 17 or 19. The post 17 is shown inserted into a channel 46 (FIG. 3) from the side 45 of the handle 11. To mount the handle 11 on the post 19, the post 19 is inserted into the same channel 46 from the side 47. The posts 17, 19 and channel 46 are shaped (as illustrated, with corresponding irregular cross-sectional configurations) to assure the preselected canted attitude of the grip 37 in the depending forward direction illustrated by FIG. 2. Each handle is approximately symmetrical with respect to the central longitudinal axis L.

A guard flange 51 at each side 45, 47 of the handle 11, functions as a hilt to isolate a hand grasping the grip 37 from non sterile surfaces of the light head assembly 23. In most cases, when the grip 37 is grasped, the thumb of the hand rests naturally between the spaced guards 51. The outer perimeter 53 of each guard 51 is configured appropriately to present a physical barrier in the region in which the grasping hand is actually positioned while maintaining a compact cross section. As so configured, sterilizable disposable versions of the handle may be packaged and stored within relatively less space.

Figure 3:
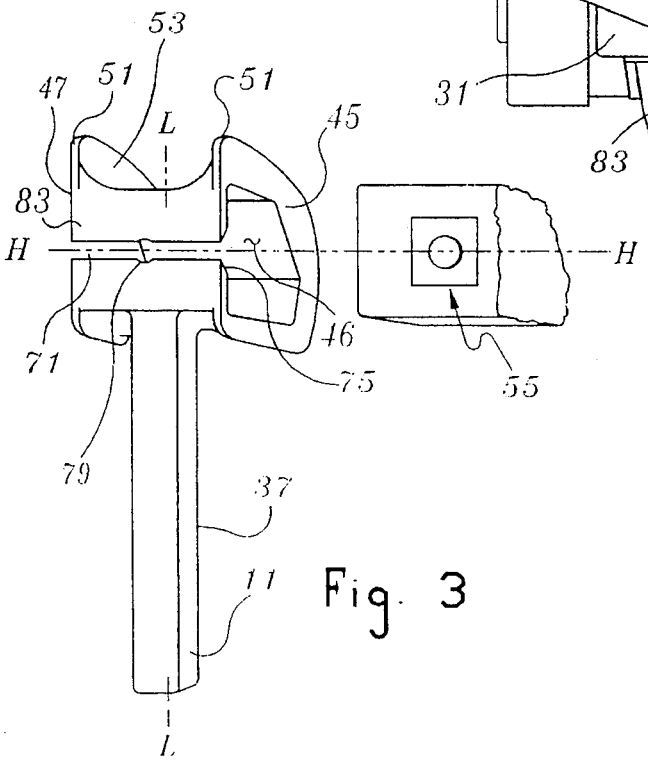
FIG. 3 is an exploded pictorial view of a preferred handle and mounting post of the invention.
Figure 4:
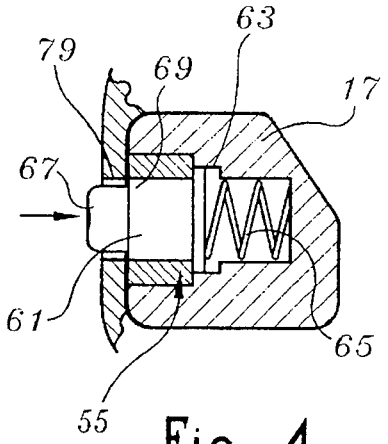
FIG. 4 is an enlarged fragmentary view of latching components of the embodiment of FIG. 3.

FIG. 3 illustrates the invention embodied as a detachable quick-release sterile handle 11 (handle 13 may be identical in construction) in combination with a mounting post 17 (mounting post 19 may be identical in construction) which houses a spring-loaded latching subassembly, designated generally 55. As best illustrated by FIG. 4, the subassembly includes a plunger 61, mounted within a cavity 63 provided in the post 17 to act against a spring 65. The plunger includes a distal release button element 67 of relatively smaller cross section, extending from a detent element 69 of relatively larger cross section. The plunger 61 may be substantially circular in cross section.

A slot 71 is provided in the handle 11 in open communication with the channel 46 and approximately parallel the channel axis H. Typically, identical subassembly 55 will be provided approximately midway along the length of the mounting posts 17, 19. Accordingly, when a mounting head 15 is positioned upon either of the posts 17, 19, a button release element 67 will inevitably extend through the slot 71. As the mounting head is advanced onto a post, e.g. 17, the detent element 69 is engaged by a ramped surface 75 (See FIG. 5) which urges the plunger 61 against the bias of the spring 65 until the detent element 69 is positioned appropriately to enter a registration well 79 located midway along the slot 71. The mounting head 15 is locked into mounted position when the detent element 69 registers with the well 79.

With the handle 11 locked in position, the release button element 67 is positioned to be accessible from the position 83 normally regarded as the rear of the handle 11 between the guard flanges 51 at the opposite sides 45, 47 of the handle 11. The release button 67 is thus out of position for actuation during normal manipulation of the head 23 by means of the handles 11, 13. A deliberate effort is required to actuate the button 67 to move the detent element 69 from the well 79, thereby to permit withdrawal of the handle 11 from the post 17. This deliberate effort involves the use of a single hand, but is inconsistent with the accidental release of a handle during normal operation.

Reference in this disclosure to specific details of the illustrated embodiment is not intended to limit the scope of the appended claims which themselves recite those details regarded as important to the invention and are intended to encompass all substantially equivalent structures.

What is claimed is:

1. A handle system for operatory fights of the type in which a light head is mounted on support structure which permits the light head to be moved in space and oriented in direction, whereby to focus and direct light through a reference plane encompassing a forward surface of said light head to a target region, said system comprising:

at least one mounting post carried by said light head and having an irregular cross-sectional configuration; and at least one handle member having a mounting head portion and a grip portion extending from said head portion, said mounting head portion having a transverse channel with a cross-sectional configuration shaped and dimensioned to register with said irregular cross-sectional configuration of said post, said mounting head and grip portions being constructed and arranged such that when said mounting head portion is installed upon said mounting post, said grip portion is fixed in a selected canted orientation with respect to said reference plane.

2. A handle system according to claim 1, further including latching assembly structure, comprising:

first structure carried by said mounting post, including a finger actuatable element for releasably locking said mounting head portion to said post; and second structure carried by said mounting head portion and structured and arranged to cooperate with said first structure, whereby releasably. to connect said handle member to said post.

3. A handle system according to claim 2 wherein said first structure is a spring biased plunger mechanism and said second structure includes registration means constructed to engage said mechanism.

4. A handle system according to claim 3 wherein said plunger mechanism includes a distal portion constituting said finger actuatable element and a detent portion, and said registration means comprises a well adapted to receive said detent portion.

5. A handle system according to claim 3 wherein said second structure comprises a slot approximately parallel said channel and said plunger mechanism is mounted such that it projects through said slot as said mounting head portion is moved onto and off from said post.

6. A handle system according to claim 5 wherein said plunger mechanism includes a distal portion constituting said finger actuatable element and a detent portion, and said registration means comprises a well adapted to receive said detent portion, said first and second structures being constructed and arranged so that finger pressure applied to said distal portion effects a disengagement of said detent portion with said well, whereby to permit removal of said handle member from said mounting post.

7. A handle system according to claim 1 wherein when said handle member is mounted on said post, said grip portion is canted at an angle of between about 20 and about 45 degrees with respect to said reference plane.

8. A handle system according to claim 7 wherein said grip portion is at least about three inches in length.

9. A handle member system according to claim 8 wherein said handle member, when mounted, is positioned substantially entirely behind said reference plane.

10. A handle system according to claim 1 including a first said mounting post carried by said light head at its left side as viewed from said reference plane; and a second said mounting post carried by said light head at its right side as viewed from said reference plane; wherein said handle member is approximately symmetrical with respect to a central plane transverse said mounting head portion, whereby said mounting head portion is structured such that it may be installed upon either of said first and second post members, and when so installed on either of said post members, said grip portion is fixed in said selected canted orientation with respect to said reference plane.

11. A handle system according to claim 10, further including latching structure, comprising:

first structure carried by each of said first and second mounting posts, each said first structure including a finger actuatable element for releasably locking said mounting head portion to respective said posts; and second structure carried by said mounting head portion and structured and arranged to cooperate with said first structure, whereby releasably to connect said handle member selectively to either of said respective posts.

12. A handle system according to claim 11, wherein each said first structure is a spring biased plunger mechanism and said second structure includes registration means constructed to engage a said plunger mechanism.

13. A handle system according to claim 12 wherein each plunger mechanism includes a distal portion constituting said finger actuatable means element and a detent portion, and said registration means comprises a well adapted to receive said detent portion.

14. A handle system according to claim 12 wherein said second structure comprises a slot approximately parallel said channel, and said plunger mechanism is mounted such that it projects through said slot as said mounting head portion is moved onto and off from said post to which that plunger mechanism is mounted.

15. A handle system according to claim 14 wherein said plunger mechanism includes a distal portion constituting said finger actuatable element and a detent portion, and said registration means comprises a well adapted to receive said detent portion, said first and second structures being constructed and arranged so that finger pressure applied to a said distal portion effects a disengagement of the associated said detent portion with said well, whereby to permit removal of said handle member from said mounting post carrying said first structure.

16. A handle system according to claim 10 wherein when respective handle members are mounted on each of said posts, the respective said grip portions are each canted at an angle of between about 20 and about 45 degrees with respect to said reference plane.

17. A handle system according to claim 16 where said grip portions are each canted at approximately identical angles with respect to said reference plane.

18. A handle system according to claim 16 wherein each said grip portion is at least about three inches in length.

19. A handle system according to claim 18 wherein said handle members, when mounted, are each positioned substantially entirely behind said reference plane.

20. A handle system for operatory lights of the type in which a light head is mounted on support structure which permits the light head to be moved in space and oriented in direction, whereby to focus and direct light through a reference plane encompassing a forward surface of said light head to a target region, said system comprising:

a pair of mounting posts carried at opposite sides of said light head, said posts being substantially mirror image duplicates of each other; and a pair of substantially identical handle members, each said handle member having:

a mounting head portion and a grip portion extending from said head portion, said mounting head portion having first and second sides and a transverse channel extending between said first and second sides, said transverse channel having a cross-sectional configuration shaped and dimensioned to register with an irregular cross-sectional configuration of either of said posts.

21. A handle system according to claim 20 wherein said mounting head and grip portions are constructed and arranged such that when a said mounting head portion is installed upon a said post member, the corresponding said grip portion is fixed in a selected canted orientation with respect to said reference plane.

22. A handle system according to claim 21 wherein each said handle member is approximately symmetrical with respect to a central plane transverse said mounting head portion of said handle member, whereby said mounting head portion is structured such that it may be installed upon either of said mounting posts and when so installed on either of said posts, said grip portion of said handle member is fixed in said selected canted orientation with respect to said reference plane.

23. A handle system according to claim 22, further including latching assembly structure, comprising:

first structure carried by each of said mounting posts, each said first structure including a finger actuatable element for releasably locking said mounting head portion to respective said posts; and second structure carried by each said mounting head portion and structured and arranged to cooperate with each of said first structures, whereby releasably to connect each of said handle members to either of said respective posts.

24. A handle system according to claim 23, wherein each said first structure comprises a spring biased plunger mechanism and each said second structure includes registration means constructed to engage said plunger mechanism.

25. A handle system according to claim 24 wherein each said plunger mechanism includes a distal portion constituting said finger actuatable element and a detent portion, and each said registration means comprises a well adapted to receive said detent portion.

26. In an operatory light of the type in which a light head is mounted on support structure which permits the light head to be moved in space and oriented in direction, whereby to focus and direct light through a reference plane encompassing a forward surface of said light head to a target region, an improved handle system comprising:

at least one mounting post carried by said light head and having an irregular cross-sectional configuration; and at least one handle member having a mounting head portion and a grip portion extending from said head portion, said mounting head portion having a transverse channel therethrough with a cross-sectional configuration shaped and dimensioned to register with said irregular cross-sectional configuration of said post, said mounting head and grip portions being constructed and arranged such that said handle member may be mounted upon said post with said post inserted within said channel, whereby to position said grip portion in a selected canted orientation with respect to said reference plane.

27. An improvement according to claim 26, including:

first and second mounting posts carried at respective opposite sides of said light head, said first and second mounting posts being approximately mirror image duplicates of each other; and first and second approximately identical handle members, each of said first and second handle members being mounted selectively on either of said first and second mounting posts.

28. An improvement according to claim 27 wherein each of said first and second handle members is approximately symmetrical with respect to a central plane transverse said mounting head portion of said handle member, whereby each said handle member may be installed upon either of said mounting posts with said grip portion of said handle member fixed in said selected canted orientation with respect to said reference plane.

29. An improvement according to claim 26, further including:

first and second mounting posts carried at respective opposite sides of said light head, said first and second mounting posts being approximately mirror image duplicates of each other; and latching subassemblies carried by each of said first and second mounting posts, each said subassembly including a finger actuatable element for releasably locking said mounting head portion to respective said first and second mounting posts;

each of said first and second mounting head portions being structured and arranged to cooperate with each of said subassemblies, whereby releasably to latch said handle member selectively to either of said respective first and second mounting posts.

* * * * *